US010392897B2

(12) United States Patent
Wise et al.

(10) Patent No.: US 10,392,897 B2
(45) Date of Patent: Aug. 27, 2019

(54) FLOW BACK RETRIEVAL METHOD FOR BOREHOLE PLUG WITH A LOWER SLIP ASSEMBLY

(71) Applicant: BAKER HUGHES, A GE COMPANY, LLC, Houston, TX (US)

(72) Inventors: Tristan R. Wise, Spring, TX (US); Zachary S. Silva, Houston, TX (US); Elias Pena, Katy, TX (US); Gabriel F. Casanova, Rayne, LA (US); Hector O. Gonzalez, Humble, TX (US); William B. Handy, Lakewood, CO (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 182 days.

(21) Appl. No.: 15/605,716

(22) Filed: May 25, 2017

(65) Prior Publication Data

US 2018/0340395 A1 Nov. 29, 2018

(51) Int. Cl.

| | |
|---|---|
| ***E21B 33/129*** | (2006.01) |
| ***E21B 23/04*** | (2006.01) |
| ***E21B 23/01*** | (2006.01) |

(52) U.S. Cl.

CPC ..... *E21B 33/1291* (2013.01); *E21B 23/01* (2013.01); *E21B 23/04* (2013.01)

(58) Field of Classification Search

CPC ..... E21B 33/1291; E21B 23/01; E21B 23/04; E21B 23/08

See application file for complete search history.

(56) References Cited

U.S. PATENT DOCUMENTS

| | | | | |
|---|---|---|---|---|
| 3,684,010 | A * | 8/1972 | Young | E21B 33/1291 166/129 |
| 6,167,963 | B1 | 1/2001 | McMahan et al. | |
| 7,036,602 | B2 | 5/2006 | Turley et al. | |
| 7,080,693 | B2 | 7/2006 | Walker et al. | |
| 7,389,823 | B2 | 6/2008 | Turley et al. | |
| 8,002,030 | B2 | 8/2011 | Turley et al. | |
| 8,191,633 | B2 | 6/2012 | Frazier | |
| 8,240,390 | B2 | 8/2012 | Hendrickson et al. | |
| 2010/0206580 | A1 * | 8/2010 | Tessari | E21B 10/64 166/377 |
| 2014/0190685 | A1 | 7/2014 | Frazier et al. | |

* cited by examiner

*Primary Examiner* — Brad Harcourt

(74) *Attorney, Agent, or Firm* — Shawn Hunter

(57) ABSTRACT

A borehole plug or packer for treating is designed to be flowed back to a surface location after use. When the treatment is concluded pressure from above is relieved or lowered, and well fluid is flowed back, so that the plug or plugs disengages at slips designed to resist differential pressure from above. The application of differential pressure from below causes the lower slips to release one or more of such plugs in the hole into specialized sub surface or surface capture equipment so that well pressure is relieved before removal of the plugs from specialized subsurface or surface capture equipment.

16 Claims, 2 Drawing Sheets

FLOW BACK RETRIEVAL METHOD FOR BOREHOLE PLUG WITH A LOWER SLIP ASSEMBLY

FIELD OF THE INVENTION

The field of the invention is borehole barriers and more particularly designs that see pressure from above and are retrieved to a surface or subsurface location by lowering pressure from above and flowing uphole through the plug above an established flow rate.

BACKGROUND OF THE INVENTION

Borehole plugs are used in a variety of applications for zone isolation. In some applications the differential pressure experienced in the set position can come from opposed directions. These plug typically have a sealing element with mirror image slips above and below the sealing element. The plug is set with a setting tool that creates relative movement between a setting sleeve that is outside the mandrel and the plug mandrel. The slips have wickers oriented in opposed directions and ride out on cones to the surrounding tubular. The sealing element is axially compressed after the first set of slips bite followed by setting of the other set of slips on the opposite side of the sealing element from the first slip set to set. The set position of these elements is maintained by a body lock ring assembly. Body lock ring assemblies are in essence a ratchet device that allows relative movement in one direction and prevents relative movement in the opposite direction. The relative movement that compresses the sealing element and drives the opposed slips out on respective cones is locked by a body lock ring. Body lock rings are threaded inside and out and sit between two relatively movable components. The thread forms are such that ratcheting in one direction only is enabled. A good view of such a design is shown in FIG. 13 of U.S. Pat. No. 7,080,693. The trouble with such a design in applications where the plug needs to be quickly milled out after use such as in treating or fracturing is that the shear loading on the ratcheting patterns is so high that the ratchet teeth break at loads that are well within the needed operating pressure range for the plug. With fracturing pressures going up and the use of readily milled components such as composites a new approach to locking was needed. The goal during treating is to hold the differential pressure from above while keeping the design simple so as not to prolong the milling time for ultimate removal. A typical zone treatment can involve multiple plugs that need to be removed. Elimination of upper slips when using the lock ring of the present invention also shortens milling time. Better yet, milling of the plugs can be avoided by lowering pressure from above to induce flow back from the stage below the targeted plug, until the slips of the plug or series of plugs to disengage and come up to a surface location such as into specialized surface or subsurface equipment where the pressure can be relieved and the plug or plugs safely removed.

The lock ring is preferably split to ease its movement when axial opposed forces are applied to set the plug. The ring is tapered in cross section to allow it to act as a wedge against reaction force tending to relax the components from the set position. The side of the ring facing the mandrel has a surface treatment that provides minimal resistance in the setting direction and digs into the mandrel to resist reaction forces from the compressed sealing element in the set position. Preferably the surface treatment is a series of extending members oriented downhole with sharp ends that can dig into the mandrel for a firm grip. These and other aspects of the present invention can be better understood by those skilled in the art from a review of the description of the preferred embodiment and the associated drawings while recognizing that the full scope of the invention is to be determined from the appended claims.

Multicomponent body lock rings have been made of easily milled materials such as composites as illustrated in US 2014/0190685; U.S. Pat. Nos. 8,191,633; 6,167,963; 7,036,602; 8,002,030 and 7,389,823. The present invention presents a way to avoid milling altogether so that the use of composites that aid milling become an optional feature. This can reduce the cost of each plug in treatments that frequently involve multiple plugs. U.S. Pat. No. 8,240,390 is relevant to packer releasing methods.

SUMMARY OF THE INVENTION

A borehole plug or packer for treating is designed to be flowed back to a subsurface or surface location after use. The plug handles differential pressure from above using a lower slip assembly under a sealing element. A setting tool creates relative axial movement of a setting sleeve and a plug mandrel to compress the seal against the surrounding tubular and set the slips moving up a cone against the surrounding tubular to define the set position for the plug. The set position is held by a split lock ring having a wedge or triangular sectional shape and a surface treatment facing the mandrel that slides along the mandrel during setting movement but resists opposed reaction force from the compressed sealing element. The surface treatment can be a series of downhole oriented ridges such as a buttress thread that preferably penetrate the mandrel when holding the set position. When the treatment is concluded pressure from above is relieved or lowered so that the plug or plugs disengage at slips designed to resist differential pressure from above. The application of flow from below causes the slips to release one or more of such plugs in the hole in order to flow uphole into specialized surface or subsurface equipment so that well pressure is relieved before removal of the plugs from the well.

DETAILED DESCRIPTION OF THE PREFERRED EMBODIMENT

Figure 1:
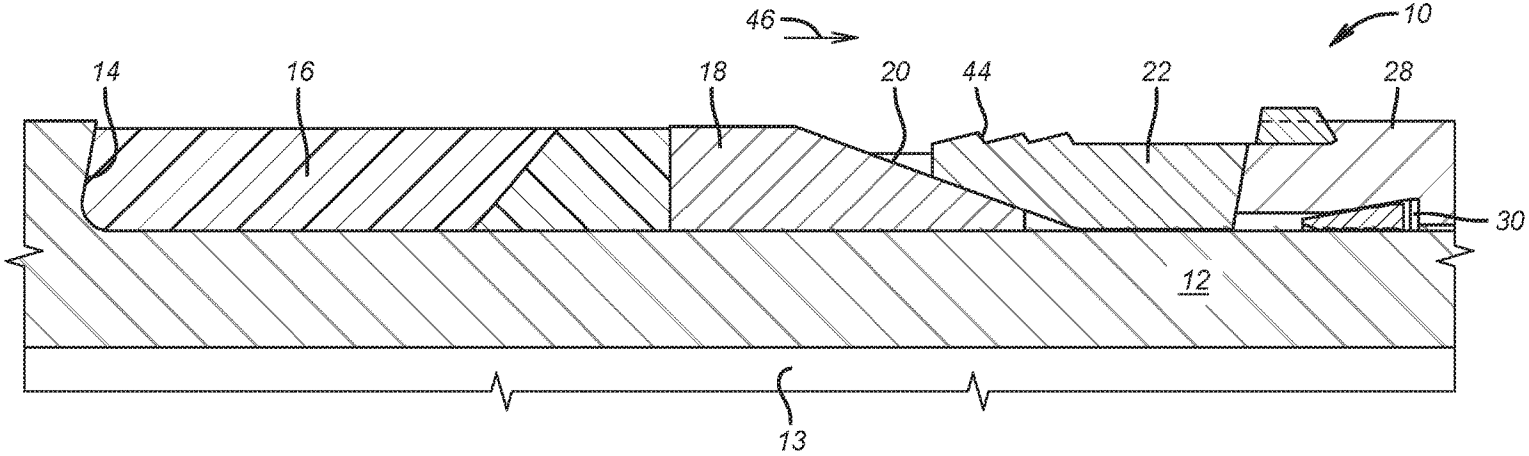
FIG. 1 is a section view of the plug in the run in position.
Figure 2:
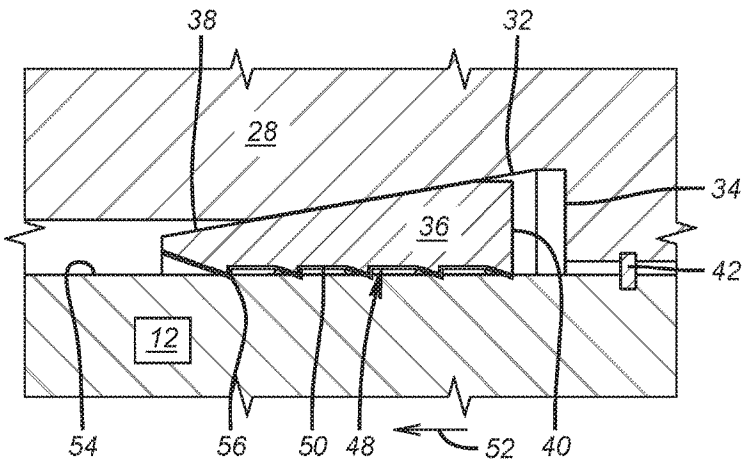
FIG. 2 is a close up view of the lock ring shown in FIG. 1.
Figure 3:
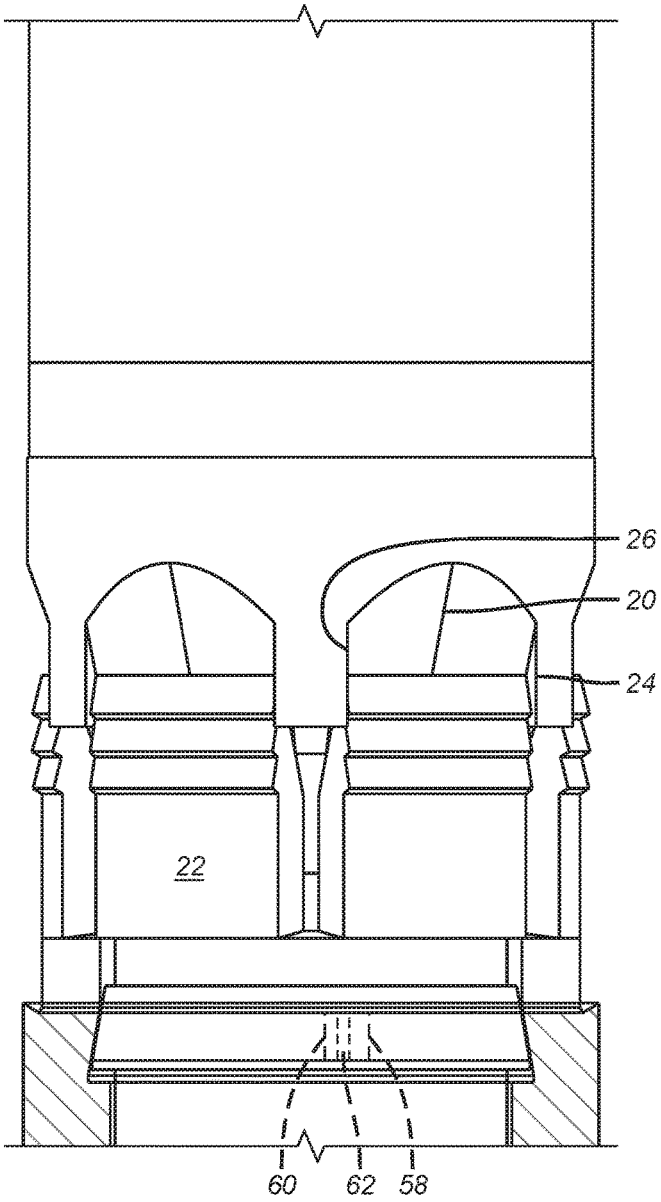
FIG. 3 is an exterior view of the plug.

Referring to FIG. 1 the plug or packer 10 has a mandrel 12 preferably made of a readily milled material such as a composite. Mandrel 12 can optionally have a passage 13 that can be optionally closed with a ball landed on a seat or with a valve (not shown). Shoulder 14 supports sealing element 16. A cone 18 has individualized tapered surfaces 20 on which a slip 22 is guided between opposed surfaces 24 and 26. The slips 22 are each connected to a slip ring 28 that has a triangular undercut 30 when viewed in section in FIG. 1 that extends for 360 degrees, preferably. The undercut is defined by surfaces 32 and 34 as better seen in FIG. 2. Lock ring 36 has an outer surface 38 that is preferably parallel to surface 32 of undercut 30. Bottom surface 40 of ring 36 is contacted by surface 34 of undercut 30 during the setting process. A shear pin or some other breakable member 42 allows the sealing element 16 to be compressed against a surrounding tubular that is not shown before the slips 22 are released to move up ramp surfaces 20 by the breaking of the shear pin 42. Movement of ring 28 relative to mandrel 12 brings together surfaces 34 and 40 to push the lock ring 36 in tandem with ring 28 during setting with a setting tool that is well known and is not shown and which serves as the force to brace the mandrel 12 while applying compressive force to the sealing element 16 and then extending the slips 22 against the surrounding tubular. The slips 22 have a surface treatment such as wickers 44 that resist reaction force from the compressed sealing element 16 as well as applied pressure loads from uphole applied in the direction of arrow 46. Because the wickers 44 are designed to hold pressure differential from above they are oriented downhole so that when the flow back rate is significantly increased the wickers 44 will disengage from the surrounding borehole wall, usually a tubular and the plug 10 will come loose. If there is a ball landed on a seat in the plug it may lift off and come uphole or lift and come uphole to seat on the next borehole plug. The flow through the plug will be sufficient to propel that plug into the plug above it, if any, and then further up the hole into specialized surface or subsurface equipment for isolation and depressurization so that the plug or plugs can be removed.

The lock ring 36 has a surface treatment 48 on bottom surface 50 that faces the mandrel 12. During setting when the ring 28 takes lock ring 36 with it the surface treatment 48 rides along surface 54 of mandrel 12 without penetration of surface 54. However, after the set and release from the plug by the setting tool the reaction force from the sealing element 16 causes the downhole oriented ribs 56 to penetrate the surface of the mandrel 12 to brace the lock ring 36 so that it can act as a wedge using surface 38 to prevent motion of ring 28 in the direction of arrow 46.

Lock ring 36 can run continuously for nearly 360 with a single split to facilitate assembly to the mandrel 12. Alternatively, there can be discrete spaced segments for the majority of the 360 degree extent of the undercut 30. Undercut 30 can be continuous or discontinuous for 360 degrees to retain lock ring 36 when lock ring 36 is formed of discrete segments. The wedging action between surfaces 32 and 38 reduces the stress in an axial direction parallel to surface 54 to discourage shear failure of the ribs 56 while the preferred composite construction of the mandrel 12 encourages penetration through surface 54. The wedging action creates a radial and axial component forces to the ribs 56 to increase the penetration into the mandrel 12 and to decrease the axial shear force component acting on the ribs 56 at the outer surface of said mandrel 12. The ribs 56 can be parallel or one or more spiral patterns or a thread form such as a buttress thread. The rib spacing can be equal or variable. The lock ring 36 can preferably be made of composite material or a soft metallic that can be easily drilled. Optionally, if lock ring 36 is a continuous split ring the faces 58 and 60 that define the split can be placed on opposed sides of a tab 62 on mandrel 12 to rotationally lock the two together to prevent lock ring relative rotation with respect to the mandrel 12 when milling out. When segments are used for the lock ring 36 each segment can be rotationally retained in a dedicated undercut 30 in ring 28 to rotationally secure the components when milling out. Alternatively, some or all of the above described plug 10 apart from sealing element 16 can be made of a disintegrating controlled electrolytic material to forgo the milling out altogether.

Optionally the ribs 56 can be omitted so that bottom surface 50 can make frictional contact with surface 54 with no or minimal penetration so that the retaining force is principally or entirely a frictional contact. Surface 50 can have surface roughening or it can even be smooth. While the ability to hold reaction force may be somewhat decreased without the ribs 50 there is still enough resistance to reaction force to hold the set position for some applications. Wedging action creates the frictional retention force.

Figure 4:
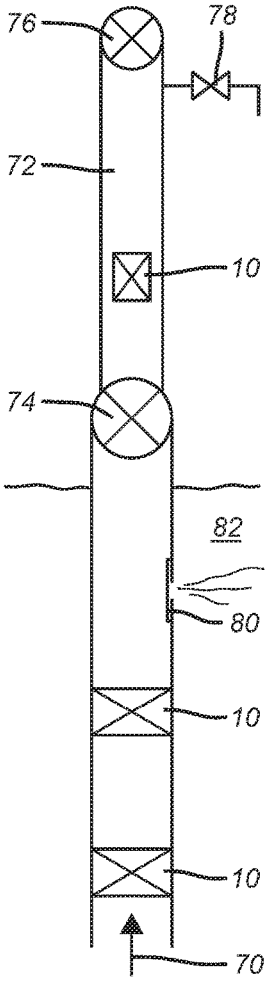
FIG. 4 is a schematic view of recovery of packers or plugs with net differential pressure.

FIG. 4 shows packers 10 still in position and others already displaced by a new uphole force shown schematically as arrow 70. This condition is normally accomplished by reducing pressure above the set packers 10 from a surface location. When a net uphole force is developed against any of the packers 10 the wickers at some level of net uphole force will no longer be able to retain the grip to the surrounding tubular and the packer 10 will move uphole. It wall pass lower valve 74 of surface or subsurface capture equipment 72 and will be stopped by the upper valve 76. Once one or more of the packers 10 are in the specialized surface or subsurface capture equipment 72, the bottom valve 74 is closed and a vent valve 78 is opened and the packers are removed out the top of the specialized surface or subsurface capture equipment 72 through valve 76. Milling is only needed if one of the packers 10 fails to come to the surface under a net uphole flow from the formation schematically represented by arrow 70. The specialized surface or subsurface capture equipment 72 can also feature a counter to give a local signal of how many packers 10 have passed into the specialized surface or subsurface capture equipment 72. As previously stated the orientation of wickers 44 in a downhole direction allows them to function to hold the set of each packer 10 with a net force applied from uphole in a downhole direction such as when performing a treatment. Care must be taken to keep a constant net force in a downhole direction to keep the packer or packers 10 in position. When the treatment ends for the zone the surface pressure is reduced and the grip of the wickers 44 is overcome. The wickers need no radial retraction, they simply give up their grip in the uphole direction as wickers 44 are not oriented to dig in in the uphole direction. This makes the design suitable for treatment where the net pressure is in a downhole direction and later retrieval where the net flow on the packer is reversed in direction to bring the packer or packers to the surface. With that the sealing element 16 cannot hold the packer 10 in position and the motion starts uphole into the specialized surface or subsurface capture equipment 72. The one way oriented wickers 44 allow fixation under a net downhole pressure and retrieval under a net uphole flow. If the packers 10 have a landed object on a seat that closes a passage through the mandrel of a packer 10 it is possible for the object to lift off the seat and then flow through the packer 10 passage as well as the net uphole flow on the mandrel will bring that packer uphole. Bringing up one or more packers can also wipe the borehole of proppant or other solids that may have accumulated in the borehole. Optionally if the borehole has sliding sleeves for zone access, the recovery of the packers 10 with flow from below can also act to close sliding sleeves on the way out of the borehole. One such sliding sleeve 80 is shown adjacent treated formation 82 although multiple such sliding sleeves can be used and operated to close or to open by the passing packers 10 depending on the application.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A method for retrieving at least one packer or bridge plug from a borehole to a surface location, comprising:

creating a differential pressure on the set at least one packer or bridge plug in an uphole direction toward the surface;

overcoming slip grip on said at least one packer or bridge plug;

leaving at least one slip extended during said overcoming; and capturing said at least one packer or bridge plug at the surface or in subsurface equipment.

2. The method of claim 1, comprising:

providing wickers on said at least one slip oriented away from the surface.

3. The method of claim 1, comprising:

performing a treatment from the surface against said at least one packer or bridge plug.

4. The method of claim 3, comprising:

performing at least one of hydraulic fracturing, stimulation, tracer injection, cleaning, acidizing, steam injection, water flooding and cementing as said treatment.

5. The method of claim 1, comprising:

providing a plurality of packers or bridge plugs as said at least one packer or bridge plug;

performing a treatment from the surface sequentially against each said packer or bridge plug;

retrieving said packers or bridge plugs by flowing well fluids back and/or reducing pressure near the surface.

6. The method of claim 1, comprising:

capturing said packer or bridge plug at the surface in specialized subsurface or surface capture equipment;

capturing said packer or bridge plug at the subsurface in specialized subsurface capture equipment.

7. The method of claim 6, comprising:

providing isolation valves on opposed ends of said specialized subsurface or surface capture equipment;

providing isolation valves on opposed ends of said specialized subsurface capture equipment; and capturing one or more packers or bridge plugs between said isolation valves.

8. The method of claim 6, comprising:

providing valves to allow flow to bypass said specialized surface capture equipment; and providing valves to allow flow to bypass said specialized subsurface capture equipment.

9. The method of claim 6, comprising:

providing a counting device to indicate how many packers or bridge plugs have entered said specialized subsurface or surface capture equipment.

10. The method of claim 1, comprising:

overcoming a retaining force by a sealing element on said at least one packer or bridge plug after overcoming a grip of said at least one slip with pressure differential in a direction toward the surface.

11. The method of claim 1, comprising:

locating said slip only downhole from a sealing element on said at least one packer or bridge plug.

12. The method of claim 10, comprising:

locking said slip when said sealing element is in a set position.

13. The method of claim 11, comprising:

retaining said slip locked during said capturing.

14. The method of claim 11, comprising:

providing a wedge between said slip and a mandrel to lock said slip in a set position;

providing at least one rib on said wedge oriented away from the surface to prevent said slip from moving relatively to said mandrel in an uphole direction.

15. The method of claim 1, comprising:

flowing well fluids back and/or reducing pressure at the surface to create a pressure differential on said at least one packer or bridge plug to move said at least one packer or bridge plug to the surface for said capturing.

16. The method of claim 1, comprising:

operating a valve with said at least one packer or bridge plug as said at least one packer or bridge plug moves toward the surface.

* * * * *